United States Patent [19]

Cockman

[11] Patent Number: 4,681,263

[45] Date of Patent: Jul. 21, 1987

[54] LOW PROFILE SPRINKLER HEAD

[76] Inventor: Haggie I. Cockman, P.O. Box 1600, Sanford, Fla. 32771

[21] Appl. No.: 759,697

[22] Filed: Jul. 29, 1985

[51] Int. Cl.[4] ..... A62C 31/02; B05B 1/26

[52] U.S. Cl. ..... 239/391; 239/396; 239/510; 239/524

[58] Field of Search ..... 239/396, 391, 390, 200, 239/201, 207, 510, 524; 47/48.5

[56] References Cited

U.S. PATENT DOCUMENTS

| | | | |
|---|---|---|---|
| 1,405,810 | 2/1922 | Wilkie | 239/390 |
| 1,741,557 | 12/1929 | Coles | 239/201 |
| 1,881,409 | 10/1932 | Le Moon | 239/396 |
| 2,130,810 | 9/1938 | Munz | 239/391 |
| 2,563,300 | 8/1951 | Aker | 239/391 |
| 2,631,889 | 3/1953 | Johnson | 239/396 |
| 2,892,594 | 6/1959 | Clark | 239/518 |

*Primary Examiner*—Andres Kashnikov
*Assistant Examiner*—Patrick N. Burkhart
*Attorney, Agent, or Firm*—Macdonald J. Wiggins

[57] ABSTRACT

A low profile sprinkler head has a circular cup-like base with a threaded male coupling for attaching to a buried water supply pipe and an axial bore therethrough. The base includes a plurality of openings to permit sand and debris to fall therethrough. A removable nozzle head is provided for insertion into the bore. The nozzle head includes fluted water passages and various configurations may be provided to produce different water spray patterns. Nozzles are designed to produce a friction fit in the bore. The upper portion of the nozzle head has a curved underside which is disposed within the base to deflect the spray in a horizontal plane. The assembly is installed below the grass mowing level to permit mowing without damage to the sprinkler head.

7 Claims, 9 Drawing Figures

LOW PROFILE SPRINKLER HEAD

BACKGROUND OF THE INVENTION

1. Field of the Invention

The present invention relates to sprinkler systems and more particularly to a low profile sprinkler head having interchangeable nozzle heads to provide different spray patterns.

2. Description of the Prior Art

In automatic lawn sprinkling systems, there are problems of damage to the sprinkler heads during mowing operations. In attempts to solve this problem, sprinkler heads have been made which have a so-called pop-up feature which requires a relatively complex and expensive design. In other approaches, removable heads are provided which require removal during mowing. Other considerations in sprinkler systems include the ability to control the sprinkler pattern. Here various mechanically adjustable diffusers have been utilized. One solution to this problem has been proposed by Aker in U.S. Pat. No. 2,563,300 which discloses the use of a portable lawn sprinkling system having sinuously curved hoses which can be bent around flower beds and the like which is disposed only during sprinkling operations. The hoses include openings therealong into which various types of sprinkler heads can be inserted. A sprinkler head snaps into an annular notch in the head stem. LeMoon in U.S. Pat. No. 1,881,409 teaches a nozzle in which a central diffusing element can be adjusted to control the spray and which is replaceable to provide various patterns of spray. In U.S. Pat. No. 4,130,247 to Healy, a nozzle device is shown in which a variety of nozzle types can be assembled from several common components by removing a screw and positioning the components in a desired arrangement. None of these prior art patents show a low cost and convenient structure which will permit use with a permanently installed lawn sprinkling system having spray heads which can be quickly and easily changed to produce a desired pattern and which may be left in place during mowing operations without damage thereto.

SUMMARY OF THE INVENTION

The present invention is a low profile sprinkler head having a circular cup-like base portion with a threaded male coupling extending downward and an axial bore therethrough. The axial bore is lightly tapered. The cup-like portion includes a plurality of openings through the wall at the base thereof to permit sand or debris to fall therethrough. A diffuser or nozzle head is provided having a tapered fluted portion projecting downward, a fluted straight central portion, and a curved mushroom shaped upper deflector portion. In one embodiment of the nozzle head, the flutes are provided over a 360 degree portion thereof. To use the nozzle head, the tapered portion is forced into the central bore of the cup shaped portion which causes a tight fit due to the taper. As will be understood, the threaded coupling portion of the sprinkler head will thread into a conventional coupling in buried water supply pipes. Water will then issue and flow through the flutes of the nozzle head and will strike the curved undersurface of the nozzle head deflector portion and produce a 360 degree pattern. Additional nozzle heads may be supplied having flutes only in selected portions of the lower part of the head which will produce other patterns. For example, 90 degree, 180 degree and 270 degree patterns can be produced by appropriate distribution of the flutes.

Due to the low profile of the sprinkler head, the upper surface thereof may be arranged to lie below the level of mowing of the grass. Thus, the blade of the mower will pass over the spray head without contacting it and damaging it.

While the spray head of the invention may be made from any suitable material, a plastic polymer is preferred for low cost, lightweight, and freedom from rust or corrosion.

It is therefore a principal object of the invention to provide a low profile sprinkler head which can lie below the level of mowing of a lawn or the like to obviate damage thereto during mowing operations.

It is another object of the invention to provide a sprinkler head having a friction fit nozzle head installed therein which can be easily changed.

It is still another object of the invention to provide a sprinkler head in which the nozzle head can be easily changed to provide a wide range of patterns.

It is a further object of the invention to provide a simple, low cost sprinkler head which can be fabricated from plastic to have a long life and freedom from corrosion.

These and other objects and advantages of the invention will become apparent from the following detailed description when read in conjunction with the drawings.

DETAILED DESCRIPTION OF THE PREFERRED EMBODIMENT

Figures 1, 2, 3, 4, 5, 6, 7, 8, 9:
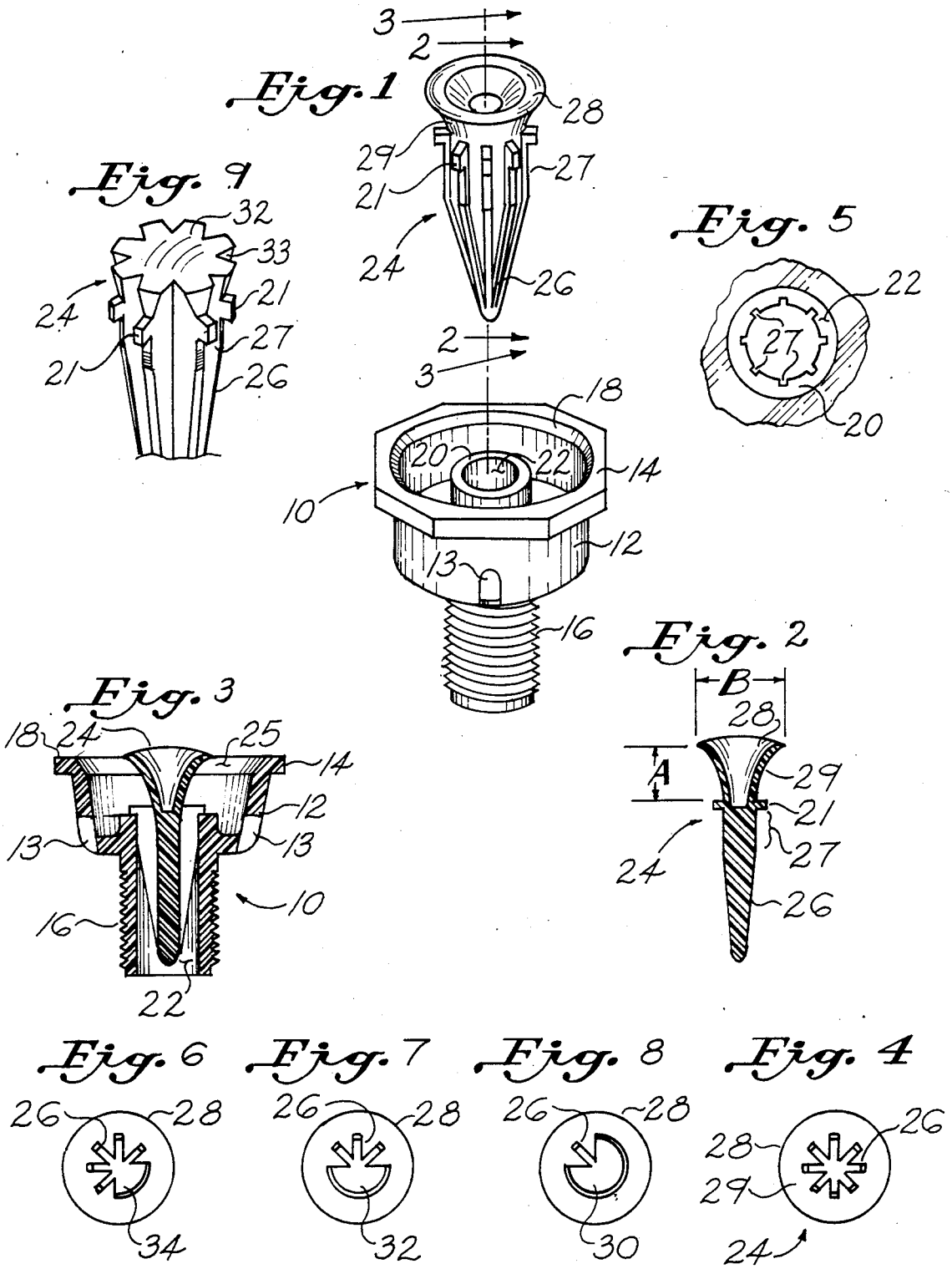
FIG. 1 is a perspective view of the sprinkler head of the invention showing the nozzle head in exploded view.
FIG. 2 is a cross-sectional view of the nozzle head of FIG. 1 in the plane 2—2.
FIG. 3 is a cross-sectional view of the sprinkler body and nozzle head of FIG. 1 in the plane 3—3.
FIG. 4 is a bottom view of the nozzle head shown in FIG. 1.
FIG. 5 is a top view of an alternative embodiment of the base portion of the invention having a plurality of grooves therein to match the flutes of the nozzle heads unit.
FIGS. 6, 7 and 8 are bottom views of alternative designs for the nozzle heads to produce various water spray patterns.
FIG. 9 shows a perspective view of an alternative deflector portion of a nozzle head having a series of notches therein.

A perspective view of sprinkler head 10 is shown in FIG. 1 with a water deflecting nozzle head 24 shown in exploded view separated from a base portion 10. Base portion 10 includes an externally threaded coupling 16 utilized to thread into a water supply pipe which is normally buried in the ground. Preferably, the body portion 10 is installed such that the rim 14 thereof is below the level at which the grass will normally be mowed. This is easily accomplished due to the shallow depth of top portion 12 of body portion 10. Rim 14 is provided with flat edges thereof to permit a spanner wrench to be utilized during installation where necessary. Body portion 10 includes a cylindical neck 20 projecting upward into the cup shaped top portion 12 as best seen in the cross-sectional view of FIG. 3. Cylindrical neck 20 includes a central bore 22 through neck 20 and coupling 16. Bore 22 tapers slightly inward from neck 20 to coupling 16. The inner edge of rim 14 is tapered inwardly providing a tapered face 18. A plurality of openings 13 is provided at the bottom edge of top portion 12 to communicate with the interior of the cup shaped top portion 10. As will be discussed hereinafter, openings 13 permit sand and other debris as well as water which may tend to collect in the cup shaped region to drain outward.

Water deflecting nozzle head 24 shown in FIG. 1 in exploded view is inserted into the bore 22 of neck 20. Nozzle head 24 includes a tapered end section 26 formed with a plurality of flutes. The tapered end section connects to a straight end section 27 having a flange portion 21. When nozzle head 24 is installed in bore 22 as will be noted from the cross-sectional view of FIG. 3, the straight end section 27 is forced into the tapered bore 20 forming a tight fit with flange portion 21 abutting the upper edge of neck 20 as best seen in FIG. 3.

At the upper end of nozzle head 24, a water deflecting portion 28 is provided having a deflector surface 29. The cross-sectional view of nozzle head 28 through the plane 2—2 of FIG. 2 shows the maximum diameter of the flutes of tapered section 26 and straight section 27 as well as flange 21. In FIG. 3, a cross section through plane 3—3 is shown for nozzle head 24 in which details of the straight end section 27 and tapered end section 26 may be seen. As will be understood, water from a water supply pipe can flow in the passage between flutes 27 and will emanate through gap 25 formed between the nozzle deflector surface 29 and the tapered lip 18 of rim 14. As will now be recognized, the width of the stream can be controlled by varying the size of the nozzle deflector portion of the nozzle head to widen or narrow gap 25.

Referring to FIG. 4, a bottom view of the nozzle head 24 illustrated in FIGS. 1, 2 and 3 is shown. It may be noted that water will flow around the 360 degree periphery of the end sections thereof. Advantageously, the tapered and straight end sections of the nozzle head may be varied to change the pattern of the water spray. For example in FIG. 6, flutes are provided over three quarters of the periphery of the end sections and will limit the spray to 270 degrees. Similarly, FIG. 7 illustrates a 180 degree design while FIG. 8 shows a 90 degree design. It will be obvious that any desired spray pattern can be obtained by varying the amount of open space for water to flow.

Referring to FIG. 3, it will be noted that the cup shaped top portion 12 of the sprinkler head forms, with neck 20, a well-like region into which sand and other debris may fall. Such material will not interfere with the spray from the sprinkler head and will tend to drain out through openings 13, especially with the assistance of the water which may also collect in the well-like portions.

In use, the base portion 10 of the sprinkler head will be installed in each desired outlet of the water supply pipes in a system. The user may then install either temporarily or permanently a particular nozzle head in each base portion of each of the sprinkler heads. For example at a corner, it would be desirable to have only a 90 degree pattern and therefore a nozzle head as shown in FIG. 8 would be the best choice. As previously mentioned, the nozzle heads are installed by simply inserting the lower tapered end section 26 in bore 22 and firmly pushing the nozzle head 24 down until it seats therein as shown in FIG. 3. The preferred material, for body portion 10 and nozzle head 24, is a polymer having a slight resiliency. The resiliency of such material ensures a tight fit which will not be disturbed by the water pressure yet will allow the nozzle head to be easily removed when it is desired to replace the head or to change the pattern. As will also be recognized, the low profile of the nozzle head and body portion of the invention allows the head to be installed below the level of mowing of the grass thereby preventing damage to the heads during mowing operations.

Turning now to FIG. 5, an alternative design of central bore 22 is shown in which a plurality of grooves 27 are cut to match the shape and positions of the flutes of tapered end section 26 and straight end section 27. This design may be desirable to ensure that the nozzle heads for various patterns are properly indexed.

In FIG. 9, an alternative design of the water deflecting portion of the nozzle head 24 is shown. Here, a series of notches 33 is cut in the periphery of nozzle head surface 32. Preferable, notches 33 are aligned with flutes 26. This embodiment changes the water spray pattern to provide a more even coverage of the sprinkler head pattern.

Although a specific embodiment has been described for exemplary purposes, various modifications in shapes and materials may be made without departing from the spirit and scope of the invention.

I claim:

1. A low profile sprinkler head comprising:

a body portion having a circular cup-like base portion;

a male, externally threaded coupling member extending downward from said base portion for coupling to a water supply, said coupling member having an axial bore therethrough; and an interchangeable nozzle head having an upper deflector portion, a straight cylindrical portion and a tapered concial portion extending downward from said upper portion for insertion into said axial bore, said straight cylindrical portion of said nozzle head thereby forming a tight friction fit in said bore, said straight and tapered portions having a plurality of water flow passages in at least a portion of the circumferences thereof.

2. The sprinkler head as recited in claim 1 in which said base portion further includes at least one opening through the outer wall thereof to permit sand and debris to pass therethrough.

3. The sprinkler head as recited in claim 1 in which said axial bore is slightly tapered.

4. The sprinkler head as recited in claim 1 in which said axial bore includes a plurality of grooves therein.

5. The sprinkler head as recited in claim 1 in which said nozzle head includes a plurality of notches around the periphery thereof.

6. The sprinkler head as recited in claim 1 in which said body portion includes a neck portion contiguous with said bore.

7. The sprinkler head as recited in claim 1 in which said straight portion of said nozzle head includes a shoulder for controlling said insertion of said nozzle head.

* * * * *